US005293796A

United States Patent [19]

Zober

[11] Patent Number: 5,293,796

[45] Date of Patent: Mar. 15, 1994

[54] AUTOMATIC TICKET VENDING MACHINE

[75] Inventor: Richard J. Zober, Croydon, Pa.

[73] Assignee: Zober Development Corporation, Croydon, Pa.

[21] Appl. No.: 823,878

[22] Filed: Jan. 22, 1992

[51] Int. Cl.[5] ..... B26D 5/20

[52] U.S. Cl. ..... 83/42; 83/208; 83/210; 83/369; 83/371

[58] Field of Search ..... 83/17, 208, 209, 210, 83/367, 369, 371, 577, 33, 370, 42; 226/27, 33

[56] References Cited

U.S. PATENT DOCUMENTS

| | | | |
|---|---|---|---|
| 3,978,958 | 9/1976 | Zandstra | 83/210 |
| 4,094,451 | 6/1978 | Wescoat | 83/210 |
| 4,436,008 | 3/1984 | Strunc | 83/371 |
| 4,572,686 | 2/1986 | Tanaka | 83/371 |
| 4,694,638 | 9/1987 | Maddux, Jr. et al. | 226/27 |
| 4,716,799 | 1/1988 | Hartmann | 83/371 |

*Primary Examiner*—Richard K. Seidel
*Assistant Examiner*—Allan M. Schrock
*Attorney, Agent, or Firm*—Austin R. Miller

[57] ABSTRACT

A method of severing a continuous strip having transversely arranged perforations into separate segments including advancing said strip along a predetermined path; deforming a portion of said strip at said transversely arranged perforations; sensing the location of said perforations by causing contact between a sensor and said deformed portion; advancing the sensed perforations a predetermined distance to a location directly in line with a severing knife; and causing the knife to sever said deformed portion at said transversely arranged perforations to form a separate segment.

13 Claims, 7 Drawing Sheets

AUTOMATIC TICKET VENDING MACHINE

BACKGROUND OF THE INVENTION

The present invention relates to a vending machine, particularly to an automatic ticket vending machine capable of precisely severing a continuous strip of tickets separated by perforations into a desired quantity of separate tickets and dispensing the separated tickets to a desired location.

FIELD OF THE INVENTION

It has been a primary objective of automatic ticket vending machines to provide for reliable and accurate severing and delivery of separate tickets from a continuous ticket strip having periodic, transversely arranged perforations between tickets. In attempting to achieve this difficult task it is necessary to sever each ticket at the transversely arranged perforations in such a manner that tolerances in the ticket advance mechanism or in the distance between perforations in the ticket strip do not accumulate and cause the delivery of incomplete tickets to the purchaser.

It has heretofore been a common problem in the art that tolerances in the ticket advance mechanism accumulate with each severed and dispensed ticket to the point that cutting or severing of tickets occurs at points other than those specifically designated, namely at the transversely arranged perforations. This is, of course, highly undesirable in that the individual tickets cut from a continuous strip of tickets are frequently no longer functional for their intended use. For example, severing at an improper location can result in vital information being cut off of a particular ticket and/or left remaining on the following ticket, such as dates, seating arrangements, times, code numbers, insignia and the like.

DESCRIPTION OF THE PRIOR ART

Applicant is aware of the following U.S. patents relating to apparatus and methods for advancing and severing continuous webs, strips, sheets and the like: U.S. Pat. Nos. 913,352; 1,090,388; 2,170,609; 2,659,435; 2,734,571; 3,079,825; 3,082,654; 4,098,158; 4,436,008; 4,527,452; and 4,572,686. Of these, U.S. Pat. No. 4,572,686 appears to be the most pertinent.

'686 discloses an apparatus for making labels. A continuous strip of labels is advanced from a printing unit through feed rolls, past a detector and to fixed and movable knives. One embodiment employs a microswitch which detects whether the continuous strip of paper on which the labels are located has an upwardly or downwardly directed fold. When an upwardly directed fold passes beneath the microswitch, an activator is pushed up and the cutters are activated at the expiration of a predetermined period. This apparatus suffers a number of deficiencies, not the least of which is the limitation that the paper strip has folds.

OBJECTS OF THE INVENTION

It is an object of the present invention to provide an apparatus and method capable of repeatedly and reliably severing and delivering tickets from a continuous ticket strip having periodic, transversely arranged perforations between tickets.

It is another object of the present invention to provide an apparatus and method to accurately sever each ticket at the transversely arranged perforations in such a manner that tolerances in the ticket advance mechanism do not accumulate and cause the delivery of incomplete tickets to the end user.

It is an important object of the present invention to provide an apparatus and method which continuously and reliably dispenses tickets to an end user wherein the tickets are cut from a continuous strip at an exact location.

Other objects and advantages of the present invention will become apparent to those skilled in the art from the drawings, the detailed description of preferred embodiments and the appended claims.

SUMMARY OF THE INVENTION

The present invention provides a method of severing a continuous strip having transversely arranged perforations into separate segments. The method includes first advancing the strip along a predetermined path, then deforming a portion of the strip at the transversely arranged perforations, sensing the exact location of the perforations in the deformed portion by causing physical contact between a sensor and the deformed portion, advancing the sensed deformed portion a predetermined distance to a location directly in line with a knife, and causing the knife to sever the deformed portion at the transversely arranged perforations to produce a separated segment.

The invention further provides for an apparatus for severing a continuous strip having transversely arranged perforations into separate segments. The apparatus includes a conveyor to advance the strip along a predetermined path, a motor connected to drive the conveyor, a roller positioned downstream of the conveyor to deform a portion of the strip at the transversely arranged perforations, a sensor positioned opposite the roller to sense the location of the perforations in the deformed portion, a first controller connected to the conveyor operative to advance the sensed deformed portion a predetermined distance to a location directly in line with a knife located downstream of the sensor, and a second controller connected to the first controller and operative to cause the knife to sever the deformed portion of the transversely arranged perforation to form a separate segment.

DETAILED DESCRIPTION OF THE INVENTION

Figure 1:
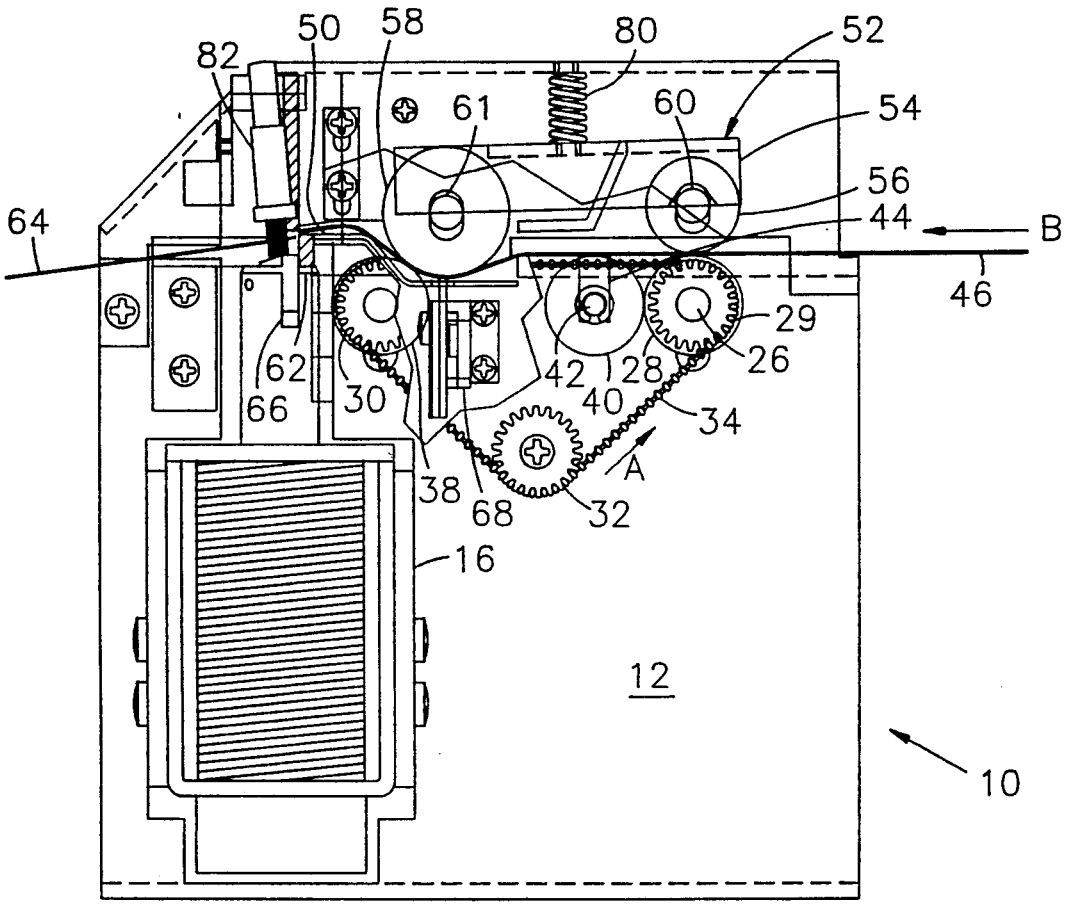
FIG. 1 is a schematic side view, partially broken away, of apparatus in accordance with aspects of the invention.

It will be appreciated that the following description is intended to refer to the specific embodiment of the invention selected for illustration in the drawings and is not intended to define or limit the invention, other than in the appended claims.

Figure 2:
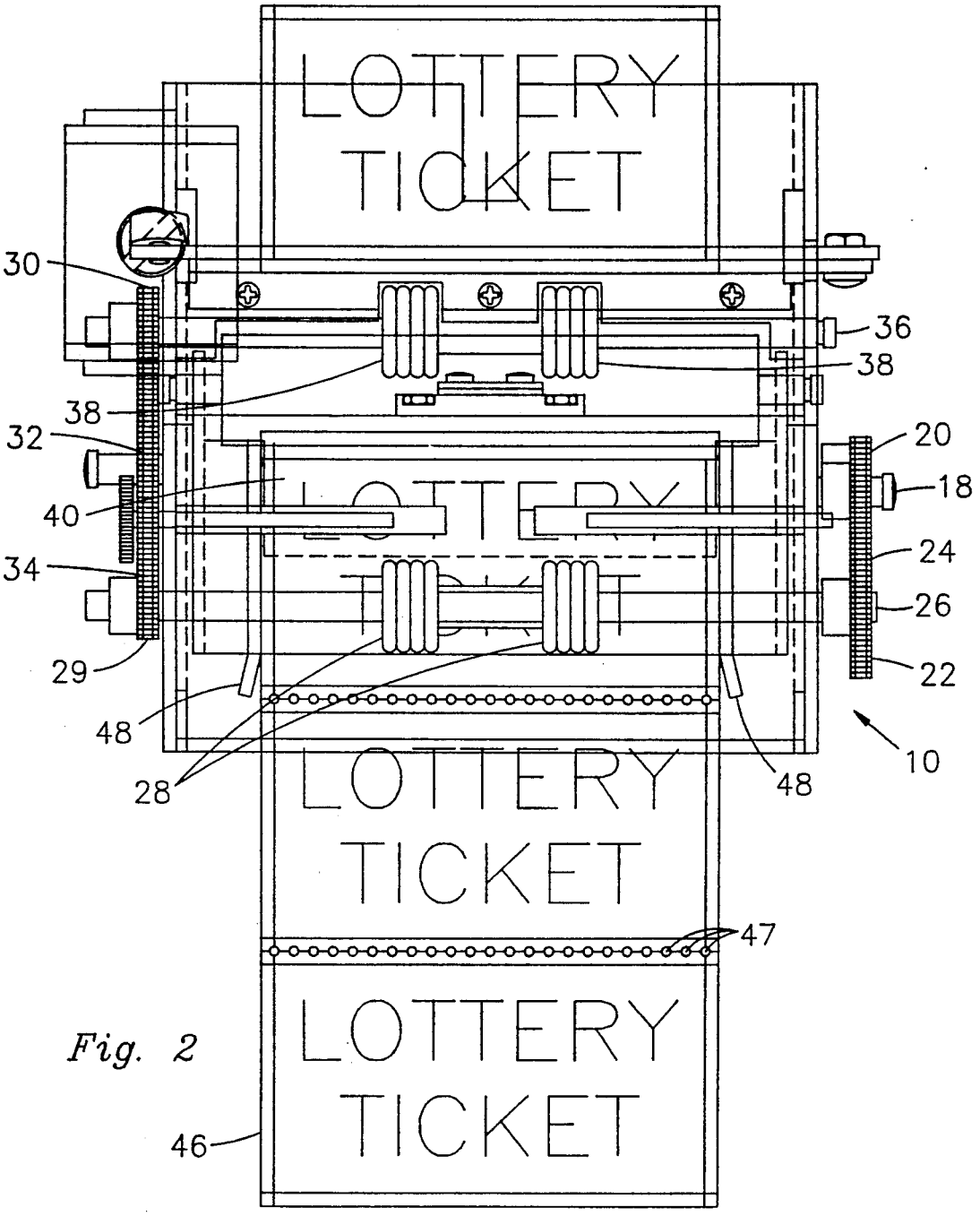
FIG. 2 is a schematic top plan view of the apparatus in FIG. 1.
Figure 3:
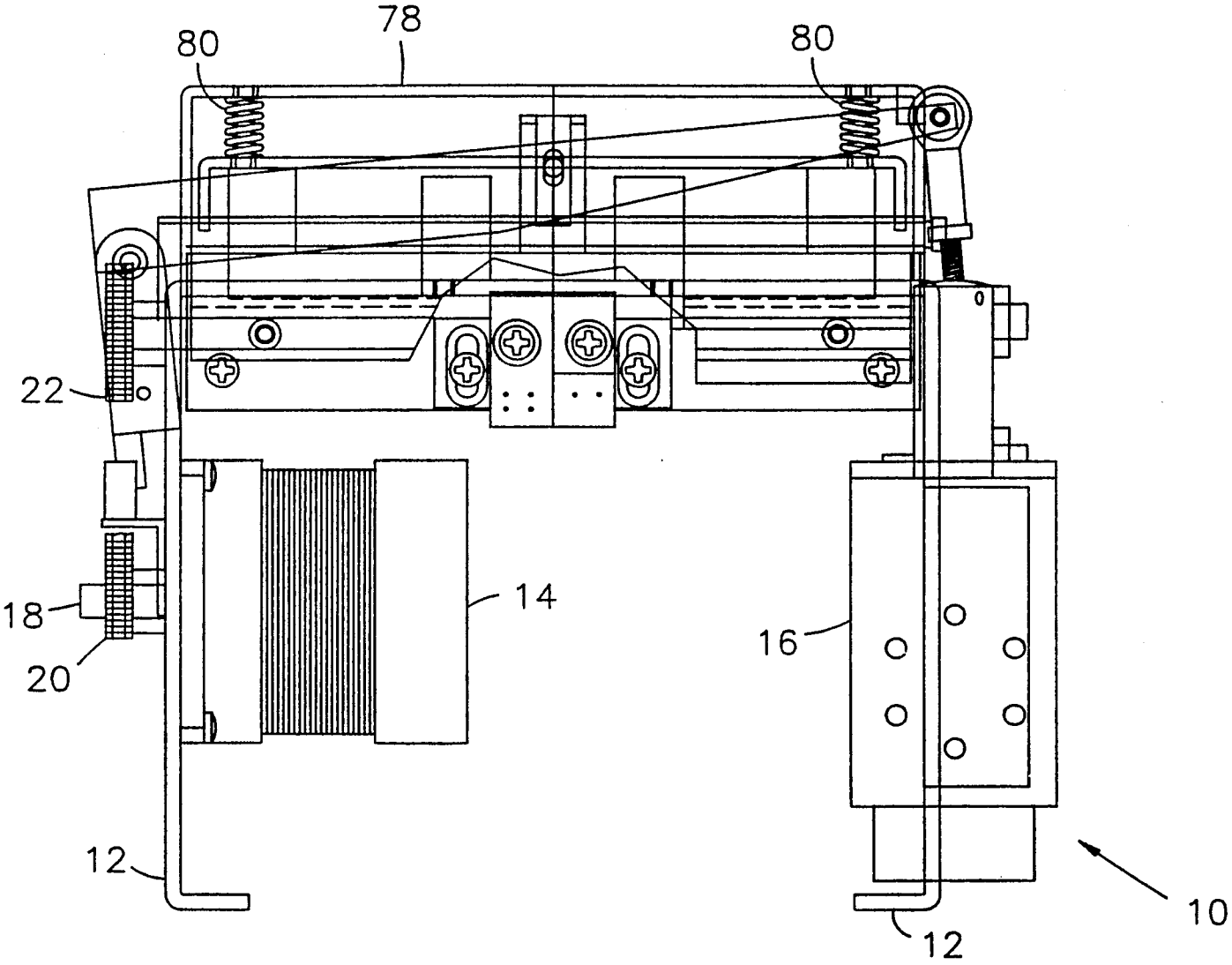
FIG. 3 is a schematic end view of the apparatus in FIG. 1.

Turning now to the specific form of the invention illustrated in the drawings, and referring particularly to FIGS. 1 through 3, the number 10 designates an automatic ticket vending machine in accordance with aspects of the invention. Vending machine 10 has a pair of downwardly extending legs 12 which support a stepper motor 14 and a solenoid 16. Stepper motor 14 has a drive shaft 18 extending outwardly of leg 12 and a drive sprocket 20 which connects to first push sprocket 22 by a drive chain 24 to rotate journal 26 and push rollers 28. Second push sprocket 29 is mounted on the opposing end of journal 26 from first push sprocket 22 and is connected to pull sprocket 30 and offset sprocket 32 by strip advancing chain 34, which moves in the direction shown by arrow "A". Pull sprocket 30 connects to pull journal 36 which supports pull rollers 38.

Support roller 40 is suspended between legs 12 by support journal 42 which connects to hangers 44. Ticket strip 46, which travels in the direction of arrow "B" and has periodically occurring and transversely arranged rows of perforations 47, lies over top of push rollers 28, support roller 40 and pull rollers 38. Ticket strip 46 also lies between guides 48 and over top of ticket strip plate 50.

Ticket strip 46 further lies underneath carriage 52. Carriage 52 includes a housing 54 which includes guide roller 56 on one end and deforming roller 58 on the other end. Guide roller 56 and deforming roller 58 connect to housing 54 by housing journals 60 and 61, respectively. Carriage 52 connects to support bar 78 with springs 80 and is positioned to move upwardly and downwardly.

Sensor 68 is positioned directly below deforming roller 58 with sufficient space to permit passage of ticket strip 46. Ticket strip 46 terminates at anvil 62 wherein a ticket 64 has just been formed by knife 66. Knife 66 connects to driver cylinder 82 which is actuated to reciprocate knife 66 upwardly and downwardly.

Figure 4:
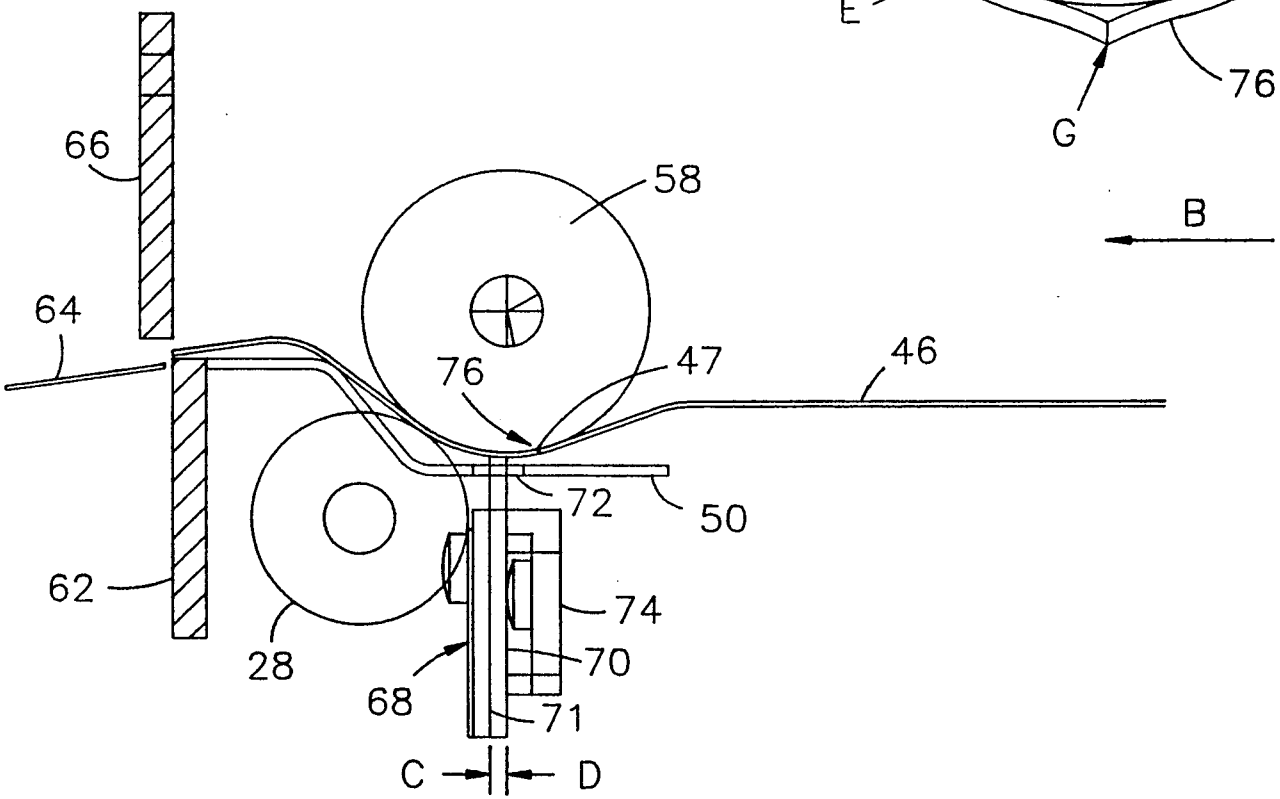
FIG. 4 is an exploded schematic side view of a roller and sensor in a first position prior to sensing a deformed portion of a continuous strip.
Figure 5:
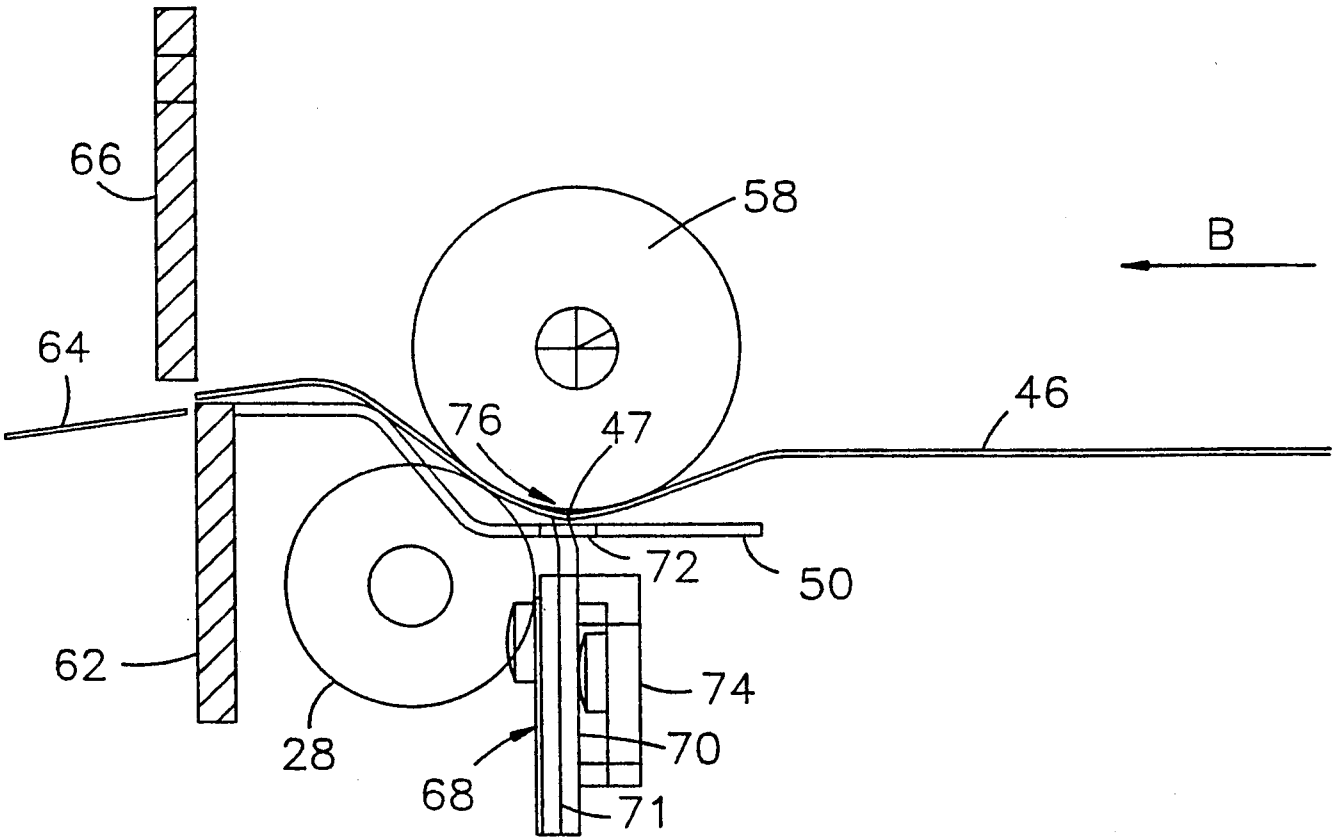
FIG. 5 is an exploded schematic side view of a roller and sensor in a position where a deformed portion of the strip is in contact with the sensor.
Figure 6:
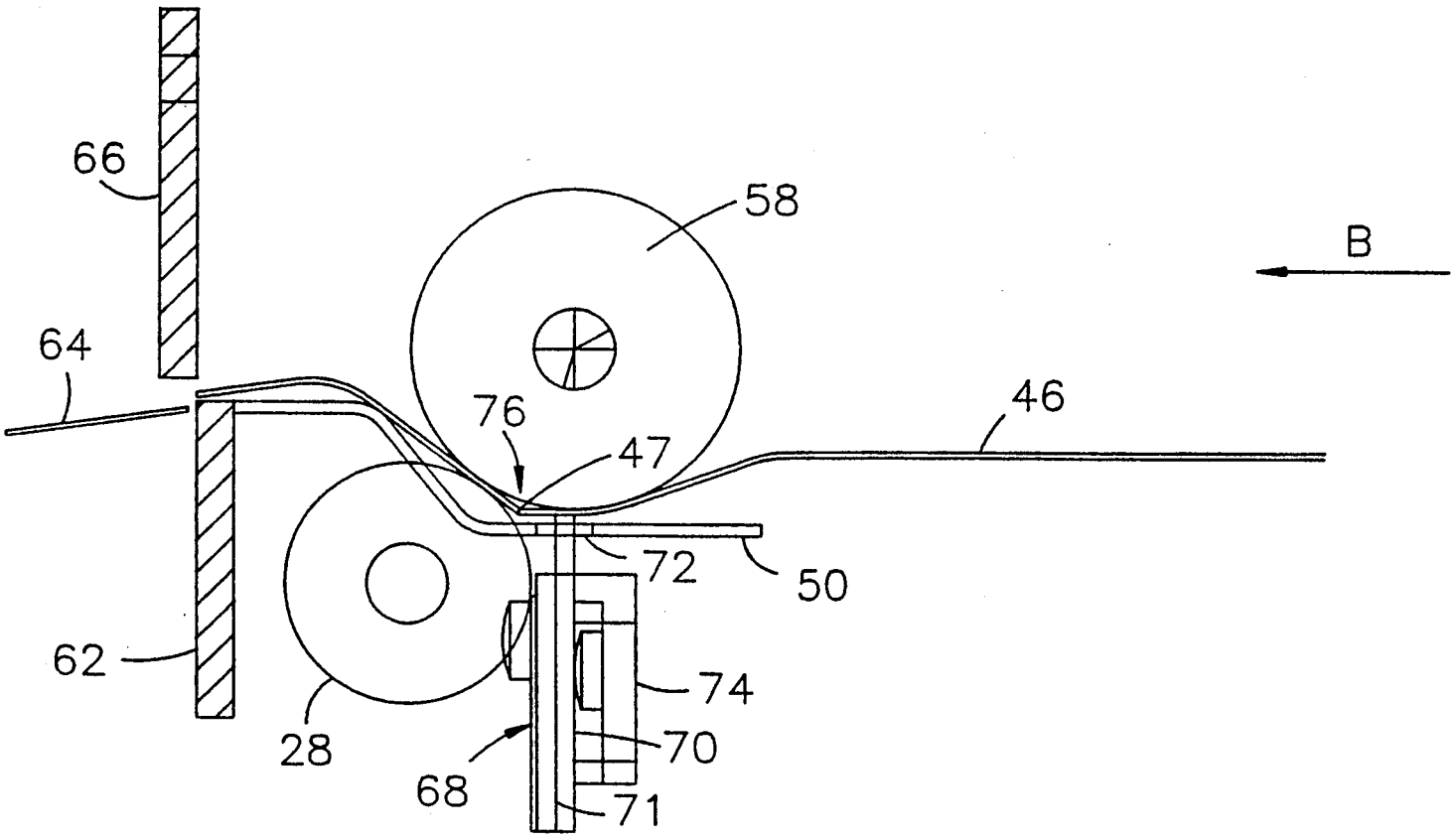
FIG. 6 is a schematic side view of a roller and sensor in a position where a deformed portion of the strip is downstream of the sensor.

FIGS. 4 through 6 show an exploded view of sensor 68 in relation to deforming roller 58, push rollers 28, ticket strip plate 50 and anvil 62. Sensor 68 includes two sheets of piezo film 70 and 71 extending upwardly through a slot 72 in plate 50 toward deforming roller 58. Piezo films 70 and 71 are held in a constant, steady position by sensor frame 74. Piezo films 70 and 71 are spaced apart by the distance shown between arrows "C" and "D". The tops of piezo films 70 and 71 are spaced from deforming roller 58 to permit passage of ticket strip 46 without lateral displacement between the films 70 and 71 that would result in a change in the distance (arrows "C" and "D") between the films.

In FIG. 4, deformed portion 76 and perforations 47 are located in a position upstream of both piezo films 70 and 71 and wherein the distance between films 70 and 71 is shown by arrows "C" and "D". In FIG. 5, deformed portion 76 is shown in contact with piezo films 70 and 71 and such contact has changed the distance between films 70 and 71 at their respective top portions. In FIG. 6, deformed portion 76 is shown downstream of piezo film 71 and films 70 and 71 have substantially resumed their position as shown in FIG. 4.

Figure 7:
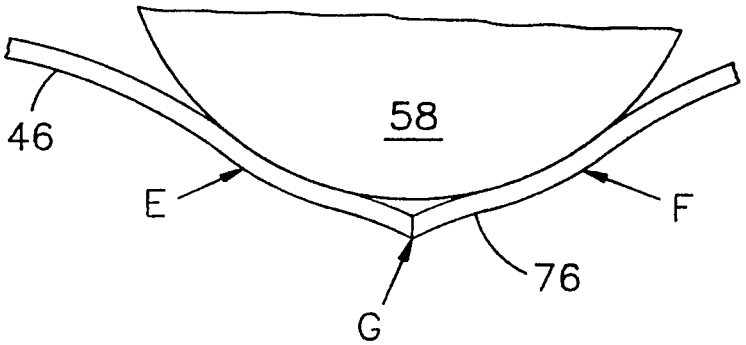
FIG. 7 is an exploded schematic view of a deformed portion of a continuous strip of tickets.

FIG. 7 shows deformed portion 76 in relation to deforming roller 58. Deforming roller 58 applies force to ticket strip 46 which causes deformation of ticket strip 46 and formation of deformed, curved portions at arrows "E" and "F". Perforations 47 cause a weakened area represented by arrow "G" which results in formation of deformed portion 76.

Figure 8:
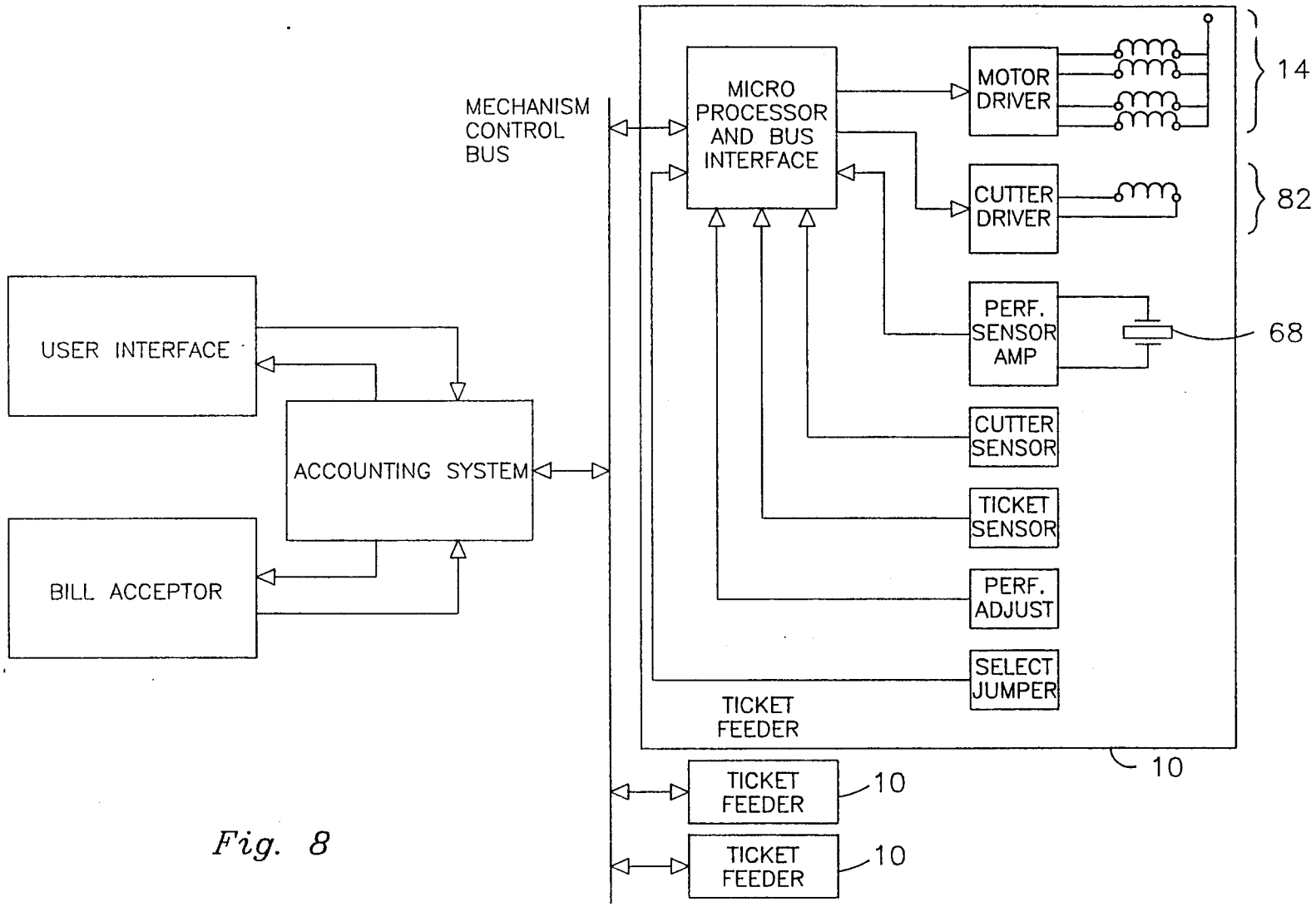
FIG. 8 is a schematic block diagram of electrical components of the invention.

FIG. 8 shows a schematic view of the electrical system of the invention, a portion of which is exploded for ease of understanding. The various lines which connect respective boxes contain arrowheads which indicate the flow of information signals and/or electrical impulses The arrows represent in a schematic format electrical connection information transmission lines, the particular form of which is not critical and all of which are well known in the art and not discussed herein.

The three boxes on the left hand side of FIG. 8, namely the "user interface", "accounting system" and "bill acceptor boxes", represent preferred features of the invention and can be customized, changed, deleted, enhanced, etc. to tailor the capabilities of the overall ticket dispensing system as needed. The user interface represents operating controls/buttons which a customer uses to interface with a particular ticket dispensing machine. Such controls/buttons activate functions which include, for example, the type of ticket requested, the number of tickets requested and the like.

The bill acceptor is essentially a money sensor which detects input of coins and/or paper bills into the machine, totals the quantity of moneys inputted into the machine and sends a signal to the accounting system element indicative of such inputs.

The accounting system preferably has the primary function of tracking the total quantity of moneys inputted into the bill acceptor, as well as the total number of tickets dispensed and the total number of tickets remaining for possible sale. The accounting system can be any number of ordinary computers known in the art, which may, if desired, be connected by modem to a central control/monitoring processing location.

The accounting system connects to one or more ticket vending machines 10 as shown by the two small elements and the exploded element on the right hand side of FIG. 8. The ticket vending machine 10 substantially corresponds to the ticket vending machine 10 illustrated in the earlier Figures.

Each vending machine 10 contains a microprocessor connected to a control bus and the accounting system. The microprocessor receives numerous inputs from the select jumper, perforation adjuster, ticket sensor, cutter sensor and perforation sensor amplifier. Microprocessor outputs information to the cutter driver, motor driver and to the accounting system.

The select jumper is a preferred aspect of the invention and is essentially a diagnostic tool component that may have numerous enhanced capabilities whenever desired. The select jumper can, for example, act to test various circuits within vending machine 10 and may be capable of sending signals to the microprocessor in the event a breakdown in the circuitry or mechanical components occurs.

The perforation adjuster connects to the microprocessor and knife 66 and adjusts the distance between knife 66 and sensor 68. The perforation adjuster is frequently used upon initial set up of vending machine 10 to calibrate the exact distances between knife 66 and sensor 68.

The ticket sensor is a preferred additional sensor connected to the microprocessor which detects severed tickets and insures that a purchased ticket actually is received by the customer and further monitors that the dispensed ticket travels to the customer prior to accepting entered money into the bill acceptor at a point wherein the money is no longer returnable to the customer. The ticket sensor can be any type of physical sensor, although a photoeye is preferred.

The cutter sensor connects to the microprocessor and knife 66 and detects when knife 66 is in an up or down position (or anywhere between if desired). The cutter sensor can further be enhanced to detect numerous other characteristics such as blockage of the downstream severed ticket chute, dulling of knife 66 or other problems of a similar nature. The cutter sensor is most preferably a photoeye although other sensors known in the art may be used.

The perforation sensor amplifier connects between the microprocessor and sensor 68. The sensor amplifier simply amplifies the signals received from sensor 68 and channels them to the microprocessor. Amplifiers are well known in the art and are not discussed further herein.

The cutter driver connects between the microprocessor and driver cylinder 82 by way of solenoid 16. The cutter driver energizes solenoid 16 and may be of any number of devices capable of supplying energy to solenoid 16 to cause repeated moving of driver cylinder 82 between up and down positions.

The motor driver connects between the microprocessor and stepper motor 14. Stepper motor 14 is schematically represented in FIG. 8 as a four coil stepper motor, although various types of stepper motors may be utilized in accordance with the invention.

Referring now to the drawings generally and FIG. 8 in particular, operation of vending machine 10 will now be described. A ticket customer engages the user interface by operating appropriate controls/buttons to select the type and quantity of tickets desired. The customer inputs the necessary quantity of money, which is preferably displayed by the user interface, into the bill acceptor. Actuation of the user interface and entry of money into the bill acceptor causes signals to travel to the accounting system to trigger dispensing of a ticket from a selected vending machine 10. The accounting system accordingly sends a signal to the microprocessor which activates the other elements of the system, and especially stepper motor 14.

Actuation of stepper motor 14 causes rotation of drive rod 18 and sprocket 20, thereby resulting in movement of drive chain 24, thereby rotating journal 26 and push rollers 28. Also, rotation of journal 26 simultaneously causes rotation of second push sprocket 29.

Rotation of second push sprocket 29 causes movement of strip advancing chain 34, which results in rotation of pull sprocket 30, offset sprocket 32, pull journal 36 and pull rollers 38. Rotation of push rollers 28 and pull rollers 38 causes advancement of ticket strip 46 in the direction of arrow "B" for a desired distance. Such advancement results in detection of perforations 47 by sensor 68. (Ticket strip 46 advances from, for example, a roll of tickets stored in an adjacent position.)

Referring now to FIGS. 4–7 of the drawings, and FIG. 4 in particular, strip 46 is shown in a position prior to severing of a ticket wherein perforations 47 are located upstream of piezo film 70. Advancement of ticket strip 46 causes a portion of the ticket strip about the perforations 47 to contact deforming roller 58. Deforming roller 58 pushes the strip 46, as well as the perforated portion of the strip, downwardly into a deformed, curved condition shown at arrows "E" and "F". Presence of perforations 47 in strip 46 results in a weakened area of strip 46 shown at arrow "G" which disturbs the otherwise substantially even curvature of strip 46 and forms a deformed portion 76 as best shown in FIG. 7.

As the ticket further advances in the direction shown by arrow "B", deformed portion 76, caused by the weakness in ticket strip 46 due to perforations 47, contacts and laterally displaces the upper portion of piezo film 70. Still further advancement of ticket strip 46 also causes lateral displacement of an upper portion of piezo film 71. Lateral displacement of piezo film 70 with respect to film 71 causes the distance (as indicated between arrows "C" and "D") between the respective films to change, thereby triggering sensor 68 and causing sensor 68 to generate a signal which results in a voltage spike. The voltage spike is amplified in the perforation sensor amplifier, sent to the microprocessor and the motor driver which causes stepper motor 14 to advance ticket strip 46 a predetermined number of steps (and distance) corresponding to the known distance to knife 66 (the distance between knife 66 and sensor 68 is predetermined and adjusted upon set up of vending machine 10 with the perforation adjuster). As soon as deformed portion 76 has passed beyond piezo films 70 and 71, films 70 and 71 return to their normal, at rest vertical position as shown in FIG. 6, thereby restoring the set distance between the respective films.

When stepper motor 14 has completed the predetermined number of advancing steps, perforations 47 are then precalculated to be directly underneath knife 66. The microprocessor then sends a signal to the cutter driver which energizes solenoid 16 and sends a signal to and actuates driver cylinder 82. Driver cylinder 82 causes knife 66 to move to a downward position. Knife 66 moves downwardly and pinches ticket strip 46 between knife 66 and anvil 62, thereby cutting ticket strip 46 and producing a ticket 64. Knife 66 is then free to return to its upward position by actuation of cylinder 82 upon completion of the cut.

After ticket 64 has been severed from ticket strip 46, ticket 64 is delivered to the customer by a chute (not shown), for example, or any other suitable delivery structure or system. The ticket sensor, which is preferably a photoeye, monitors delivery of the ticket 64 and counts all severed tickets as they travel along the chute. Also, if a ticket is not sensed by the photoeye within a predetermined period of time after knife 66 has been actuated, operation of ticket vending machine 10 is preferably suspended and a suitable message such as "out of order" is displayed on the user interface. Such signals travel from the ticket sensor, through the microprocessor, through the accounting system and to the user interface. This process is repeated as many times as is desired by the customer.

Although this invention has been described in connection with specific forms thereof, it will be appreciated that a wide array of equivalents may be substituted for the specific elements shown and described herein without departing from the spirit and scope of this invention as described in the appended claims. For example, although many of the systems, wires, connections, sensors and the like are described as "electrical", such systems, etc. may be operated by fluids, optics and the like. Also, sprockets, journals, chains, rollers and the like are illustrated and described herein. These elements may be substituted with other component parts so long as their function is performed. For example, drive chains may be replaced with belts, strips, webs and the like.

Sensor 68 used herein employs two piezo films 70 and 71 instead of one film to insure that accurate sensing of perforations 47 occurs. Vibrations due to jostling, jarring or internal movement of the components of vending machine 10 could accidentally trigger actuate of motor 14 and knife 66 if sensor 68 simply relied on movement of the top of one piezo film. Hence, sensor 68 is designed to ignore movement of both films 70 and 71, which would not change the distance between arrows "C" and "D". This typically occurs when the machine is hit or jarred accidentally. Sensor 68 requires that film 70 move independently of film 71 (or vice versa) to cause a change in the distance between arrows "C" and "D" before a signal is generated.

It is claimed:

1. A method of severing a continuous strip having a plurality of transversely arranged perforations defining a plurality of sequentially arranged segments into separate segments comprising the following steps for each of said perforations:

(a) advancing said strip along a predetermined path;

(b) deforming a portion of said strip at and proximal to said transversely arranged perforation;

(c) sensing the location of said perforation by causing contact between a sensor and said deformed portion;

(d) advancing the sensed perforation a predetermined distance to a location directly in line with a severing knife;

(e) causing the knife to sever said deformed portion of said strip at said transversely arranged perforation to form a separate segment; and (f) continuously repeating steps (a)-(e) for each of said segments.

2. The method defined in claim 1 further comprising delivering said segments to a predetermined location.

3. The method defined in claim 1 further comprising counting separated segments upon formation thereof by severing from the continuous strip.

4. The method defined in claim 3 further comprising displaying a predetermined message upon failure of a separated segment to be counted within a predetermined time.

5. The method defined in claim 1 further comprising displaying a predetermined message when the continuous strip no longer has any perforations.

6. The method defined in claim 1 wherein said deformed portion physically contacts a piezo film sensor, thereby generating an electrical surge to cause a motor to advance said continuous strip.

7. Apparatus for severing a continuous strip having transversely arranged perforations into separate segments comprising:

means for advancing said strip along a predetermined path;

means located adjacent said predetermined path for deforming a portion of said strip at and proximal to each of said transversely arranged perforations;

means located adjacent said predetermined path for sensing the exact location of each deformed portion;

means connected to said sensing means for controlling said advancing means such that each sensed deformed portion is advanced a predetermined distance to a location directly in line with a severing knife; and means connected to said controlling means for causing said knife to sever each deformed portion at said transversely arranged perforations to form a separate segment.

8. The apparatus defined in claim 7 wherein said means for advancing said strip along a predetermined path comprises a housing having a substantially planer plate with upstanding side edges and being sized to receive said strip.

9. The apparatus defined in claim 7 wherein said means for deforming a portion of said strip comprises a rotatable roller extending transversely with respect to the direction of travel of said strip.

10. The apparatus defined in claim 7 wherein said means for sensing comprises a piezo film positioned opposite said deforming means and capable of producing a signal upon contact by each deformed portion.

11. The apparatus defined in claim 7 wherein said means for advancing each deformed portion comprises a stepper motor connected to said sensing means and adapted to advance said strip.

12. The apparatus defined in claim 7 wherein said means for causing said knife to sever each deformed portion of said strip comprises a cutter driver.

13. The apparatus defined in claim 10 wherein said means for sensing further comprises a second piezo film positioned proximal to said first piezo film to compensate for motion in said first piezo film not caused by contact with said deformed portion.

* * * * *